United States Patent [19]

Cobbs et al.

[11] Patent Number: 4,907,664

[45] Date of Patent: Mar. 13, 1990

[54] ROCK CUTTING TOOL

[76] Inventors: James H. Cobbs, 5350 E. 46th St., Tulsa, Okla. 74135; David C. Cobbs, 669 E. 139 Pl., Glenpool, Okla. 74033

[21] Appl. No.: 285,594

[22] Filed: Dec. 16, 1988

[51] Int. Cl.[4] ..... E21B 10/10; E21B 10/16

[52] U.S. Cl. ..... 175/374; 175/360; 175/361; 175/353

[58] Field of Search ..... 175/353, 374, 375, 361, 175/364, 376, 53, 360; 299/79, 94

[56] References Cited

U.S. PATENT DOCUMENTS

| | | | |
|---|---|---|---|
| 3,186,500 | 6/1965 | Boice | 175/374 |
| 3,250,337 | 5/1966 | Demo | 175/374 X |
| 4,167,980 | 9/1979 | Saxman | 175/374 |
| 4,202,419 | 5/1980 | Youngblood | 175/374 |
| 4,343,372 | 8/1982 | Kinzer | 175/374 |
| 4,711,143 | 12/1987 | Loukanis et al. | 175/375 X |

*Primary Examiner*—Stephen J. Novosad
*Attorney, Agent, or Firm*—Head and Johnson

[57] ABSTRACT

A drilling member for use in a drilling system, such as for drilling a large diameter subterranean hole or for removing rock at the earth's surface, in which the system employs a cutting head rotated about an axis and mounted for movement into a rock face, the cutting head having a plurality of drilling members, each of which has a truncated conical external surface rotated about the conical axis thereof, and a plurality of spaced-apart rows of indentors secured to the drilling member conical surface, the indentors being adapted to penetrate into the rock face a distance P, and wherein the indentors are spaced a distance not greater than 7 P apart.

6 Claims, 6 Drawing Sheets

Fig. 6
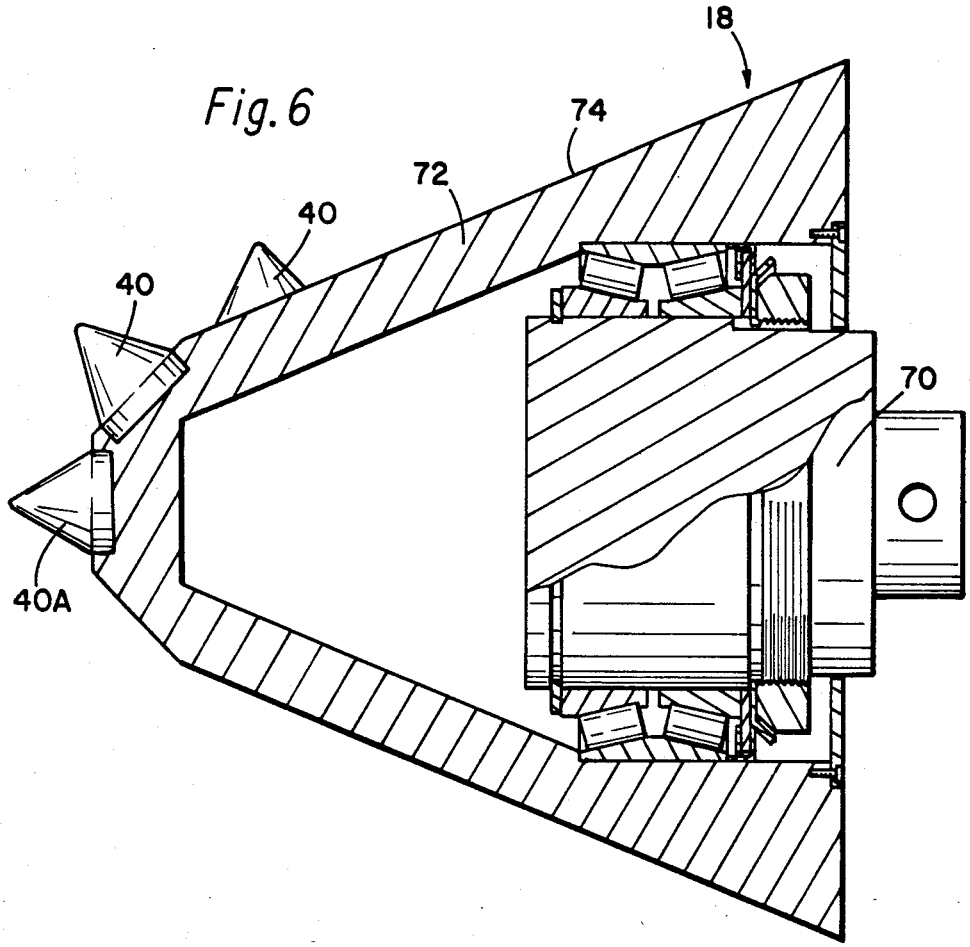
Fig. 8
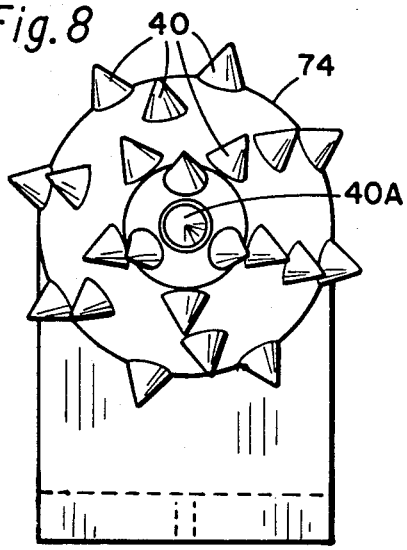
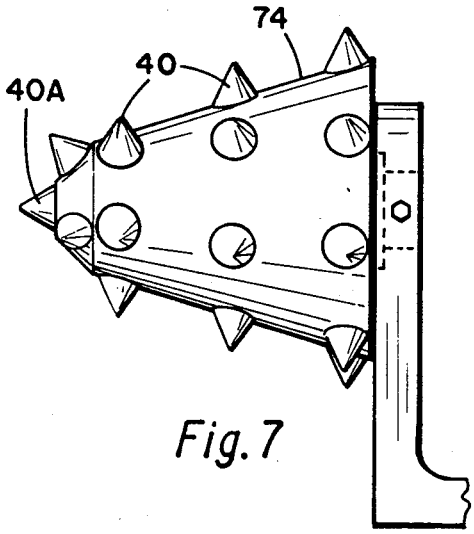
Fig. 7

ROCK CUTTING TOOL

SUMMARY OF THE INVENTION

The cutting away of rock by one means or another is vital to the construction of oil and gas wells, mine shafts, tunnels, road beds, ditches and so forth.

The drilling or boring of shafts for mines or underground civil works and the mechanical boring of tunnels enjoys a great advantage over conventional excavation by the use of explosives from the standpoint of safety during construction and the stability of the resultant structure. Unfortunately, drilling suffers a major economic disadvantage for very large diameters or when the construction is in rocks of very high strength.

Present drilling practices make use of a series of cutting tools mounted on a bit body or boring head in a way that the coverage of the cutting tools is essentially all of the rock face to be drilled. Cutter types take two general forms. The most prominent in tunnel boring operations is the disc cutter which, as the name implies, is a circular disc mounted on a shaft which cuts a kerf in the rock and when the cut is deep enough, there is failure of the rock between adjacent kerfs to create semicircular slabs of rock cuttings or chips which are then removed from the tunnel. In the boring of shafts, the most common cutter type is a truncated cone with a number of teeth or indentors which attack the rock causing failure beneath the teeth; and, under favorable spacing circumstances between indentations to create chips or cuttings which are removed from the shaft. There are a number of types of indentors or teeth which can be milled into the steel conical cutter or they can consist of hard tungsten carbide inserts placed in the truncated conical cutter body.

In the great majority of cases, the rock face being attacked by the cutting tools is virtually normal to the axis of the opening being bored. There is, on occasion, a small conical angle to the face which normally is 15° or less and one manufacturer makes a boring head which approximates a hemisphere.

The present disclosure is based upon the discovery of a critical relationship between the angle of attack of an indentor upon rock and the angular slope of the rock surface which will reduce the force necessary for the indentors to penetrate the rock. By taking advantage of indexing phenomena, the system increases the rate of penetration of the bit while simultaneously reducing the force necessary to achieve penetration. This discovery has potential for significant economic improvement in excavation by drilling with attendant improvement in the safety and stability of the openings created.

The most efficient indentor from the standpoint of force required for a given penetration is a conical indentor. In cutting rock it is known that brittle fracture is preceded by plastic fracture and the total multiple chipping fracture is a parabolic envelope with the envelope being defined by the force required to form the first plastic chip. In prior rock cutting tools brittle fracture did not always occur because the plastic chipping did not necessarily reach the envelope of brittle chipping.

In development of the present disclosure, the plastic analysis procedure was combined with tests to see if brittle fracturing can occur, and if so, to conduct the brittle fracture analysis to determine the total force requirements for an indentor to penetrate a rock of given physical properties to a predetermined depth. Analytical procedures were performed to investigate the effect of rock slope angle, indentor attack angle, indentor included angle and indentor relief angle on the forces required to penetrate rock.

It is intuitively obvious that the smaller the cross-sectional area of the indentor penetrating the rock, the lower the force requirement will be. A workable tool requires a compromise between the ideal cross-sectional area and the inherent strength of increased cross-sectional area to result in a tool of sufficient life expectancy to effectively perform its function with the minimum force. Tests have shown that a conical indentor, because of the increasing cross-sectional area as we move away from the apex of the cone, will have the most nearly ideal combination of strength and cross-sectional area.

Indexing is the fracture between two adjacent craters to form a single crater larger than the two. It has been determined that the craters formed by indentors will index with each other up to a distance of 7 times the depth of penetration of the indentors. Disc cutters take advantage of this phenomena only in one direction which is the distance between the kerfs cut by the discs while toothed cutters take advantage of indexing phenomena in two directions. The present system takes advantage of indexing in both directions to minimize the force required for cutting rock.

To take advantage of the phenomena previously observed, the present system of teeth or indentors are circumferentially arranged on a truncated conical body. The spacing of the teeth is arranged so that the distance between tooth indentations will be less than the maximum indexing distance based on the planned penetration depth of the tooth. Though the face of the cutter body is parallel to the face of the rock being drilled, the teeth are positioned in the cutter body so they attack the rock at the most favorable angle for the particular rock type.

Additional rows of teeth are positioned on the cutter body in a staggered pattern so the teeth follow the other teeth inboard from the row and each succeeding row of teeth will break rock towards a free surface toward the center of the opening being bored.

The force history on a tooth as it is indenting a rock starts at O and increases exponentially until the maximum penetration depth has been reached. By staggering the teeth in succeeding rows, the total load on the bearings within the cutter body and the supporting structure can be smoothed because only one tooth is at the maximum depth of penetration at any time. With four rows of teeth on a cutter, the load on the bearings and support structure is an almost steady two times the load on a single tooth.

By adjusting the profile of the excavation and the orientation of the teeth on individual cutters, it is possible to develop an optimum system of attack on the rock to create maximum penetration and minimize the force or loading required to achieve this penetration. Taking advantage of the indexing phenomena in both directions further reduces the force or load required to achieve maximum penetration and rate of advance. The appropriate staggering of teeth in individual rows minimizes the total force or loading required on an individual cutter along with leveling the cutter load at a nearly steady rate for maximum bearing and support structure life.

Indentors may be attached to the cutters in a number of ways. The preferred method is by casting the body around the shanks of the indentors when the body is constructed of cast iron. Other methods include pressing the indentor into a slightly undersized hole to achieve an interference fit or use of a threaded indentor screwed into the body with the threads producing an interference fit.

A better understanding of the invention will be had with reference to the following description and claims, taken in conjunction with the attached drawings.

BRIEF DESCRIPTION OF THE DRAWINGS

FIG. 6 is an enlarged cross-sectional view of the center cutter of the type shown in FIG. 1.

FIG. 7 is a reduced diameter external view of the center cutter of FIG. 6 showing a bracket by which the center cutter is mounted to a boring tool.

FIG. 8 is an end view of the center cutter and bracket.

DESCRIPTION OF THE PREFERRED EMBODIMENT

The invention will be described as it is typically applied in a tool for drilling a large diameter borehole in the earth. It is understood that this is for purposes of exemplification since the principles of the invention are applicable to other types of rock removing tools, For instance, there is a type of tool called a "road header" machine. A "road header" machine operates somewhat differently from other rock cutters in that it has an articulated boom on which a rotating cutter head is mounted. The boom then traverses a pattern of the opening to be cut and the machine offers the advantage of being able to cut virtually any profile desired whereas most other machines are limited to a circular profile. The nature of the cutter heads on road headers and the fact that nearly the only reactive force available to the machine is its weight, limits the hardness of rock which can be economically bored by road headers. Whether the principles of the present invention are applied to drilling a large diameter hole as the invention is particularly described or to a road header, the principles of the invention remain the same.

Figure 1:
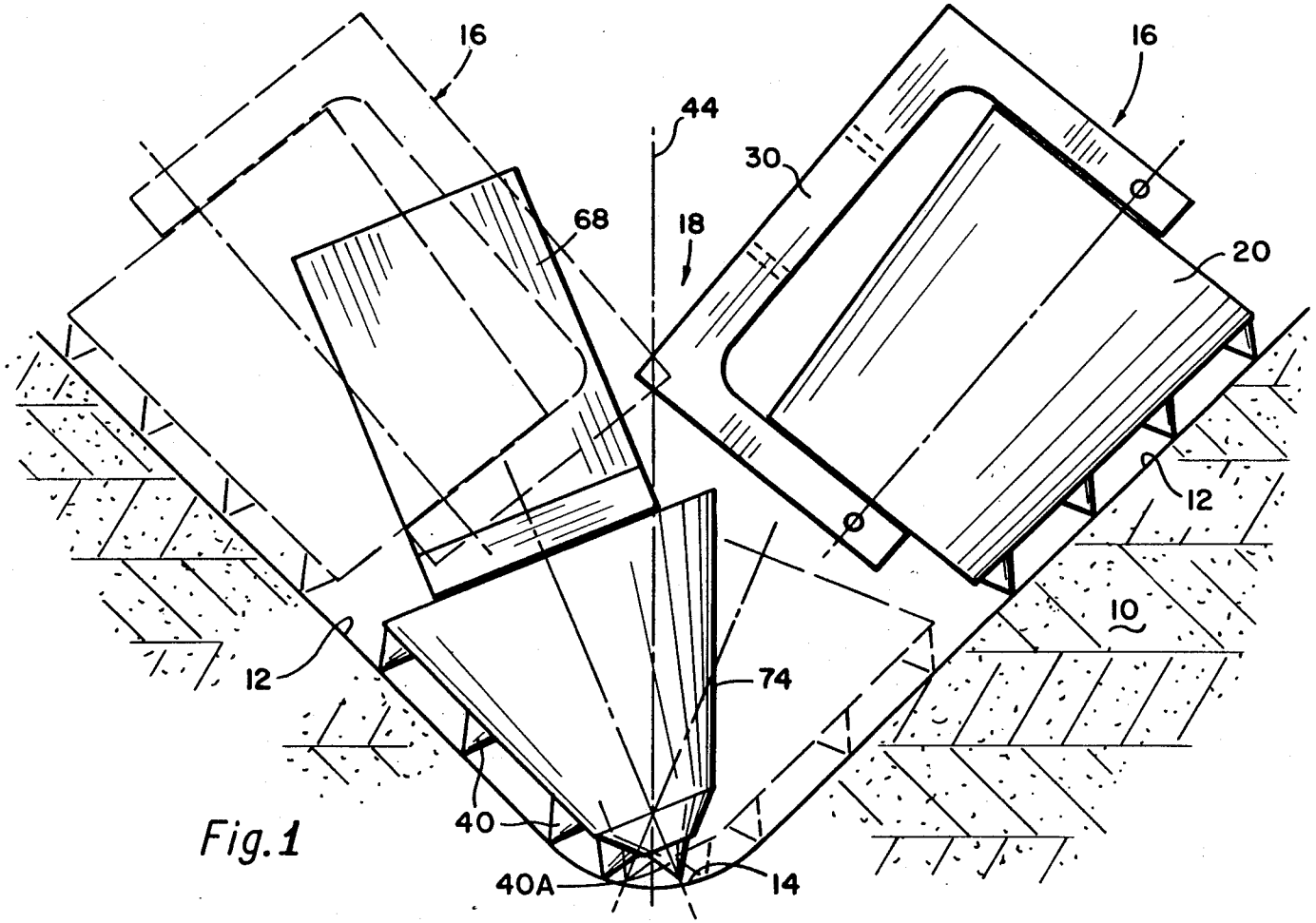
FIG. 1 is a partial view of a system employing the principles of this invention for boring a large diameter hole in earthen rock. The drawing shows two drilling members in solid outline, one being a center cutter and the other a side cutter. A second side cutter is shown in dotted outline with the understanding that typically a plurality of side cutters will be employed.

Referring to FIG. 1, elements for use in practicing the invention are shown. The figures show the forward end of a large diameter subterranean drill hole being drilled in rock. The drilling process produces a rock face 12 which is preferably V-shaped as indicated in a cross-sectional plane and extends from the apex 14 of the rock face equally in both directions to the full diameter of the hole being drilled. The drilling system includes a mechanism for rotating drilling members and which mechanism is not shown since such is commonly commercially available. As discussed in the summary, the use of rotated cutting tools or boring heads is a known practice. This invention is concerned with the drilling members which are affixed to such rotated boring heads. In FIG. 1 three of such members are illustrated. The first is a side wall drilling member generally indicated by numeral 16. A second sidewall member 16 is also indicated in dotted outline and is of the same construction and is employed to illustrate that on the typical boring head there will be a plurality of side wall drilling members. Also affixed to the boring head is a center drilling member generally indicated by the numeral 18.

Figure 2:
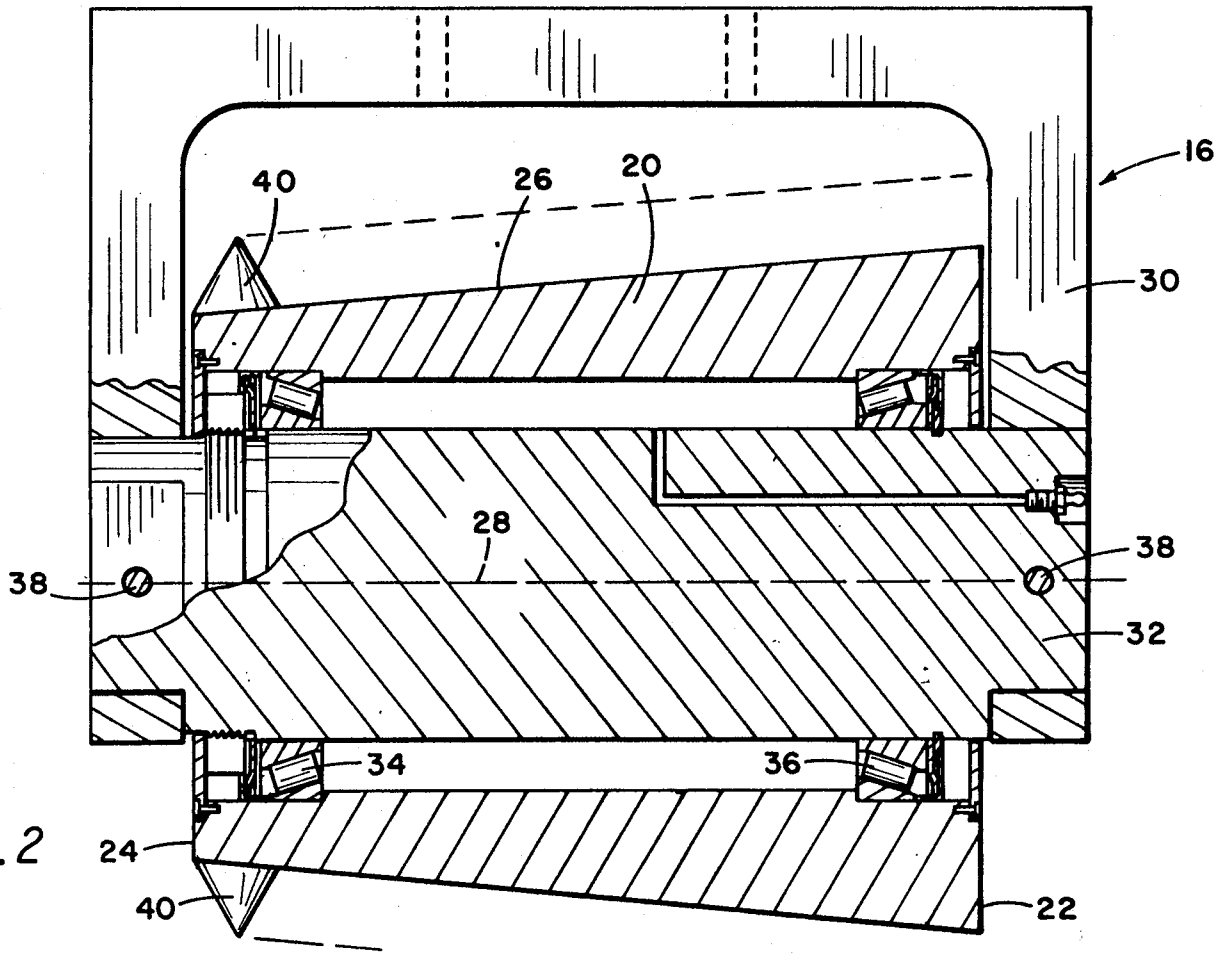
FIG. 2 is an enlarged partially cross-sectional view of a side cutter of this invention as used in a drilling system and showing the means of supporting the frusto-conical body having indentors thereon.

Referring to FIG. 2 a side wall drilling member 16 is illustrated to greater detail. The side wall drilling member includes a frusto-conical body 20 having a larger diameter end 22 and a smaller diameter end 24. The body 22 has an external surface 26 which is frusto-conical and the body is supported to rotate about frusto-conical axis 28. The body 20 is supported for rotation by a yoke 30, the yoke in turn being supported to the drilling system boring head (not shown). The yoke supports a shaft 32 and bearings 34 and 36. Pins 38 lock the shaft 32 to yoke 30 so that the frusto-conical body 20 rotates relative to the shaft and the yoke. Seals, bearing retention means, lubricating means and so forth are provided according to standard procedures for supporting rotating mechanisms in harsh applications.

Figure 3:
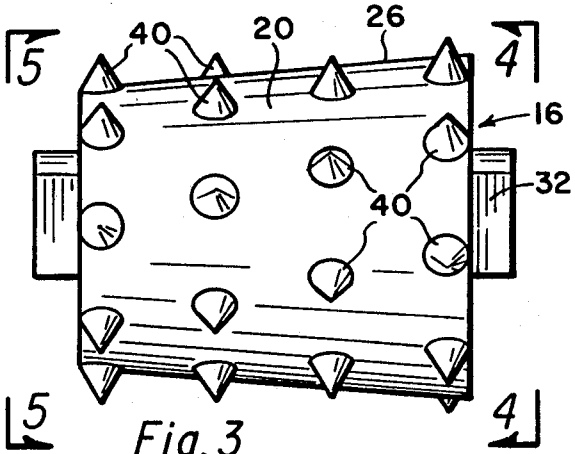
FIG. 3 is an external view of the frusto-conical body member of FIG. 2 and showing the indentors spaced on the body.
Figure 5:
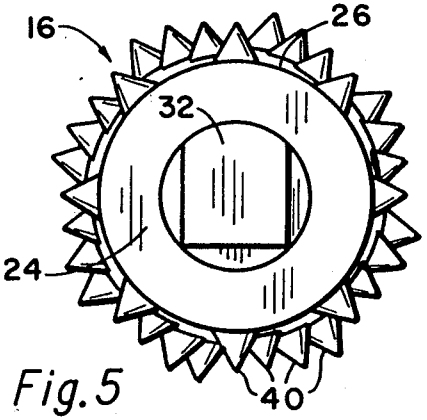
FIG. 5 is an end view taken along the line 5—5 of FIG. 3 of the frusto-conical body.

On the frusto-conical surface 26 of member 30 are spaced a plurality of rows of separate indentors 40 as shown best in FIG. 3. FIG. 3 shows the frusto-conical body 20 supported on shaft 32, but without the yoke as in FIG. 2. FIG. 3 shows the employment of four rows of indentors 40, each row being in a plane perpendicular the axis of rotation 28.

Figure 10:
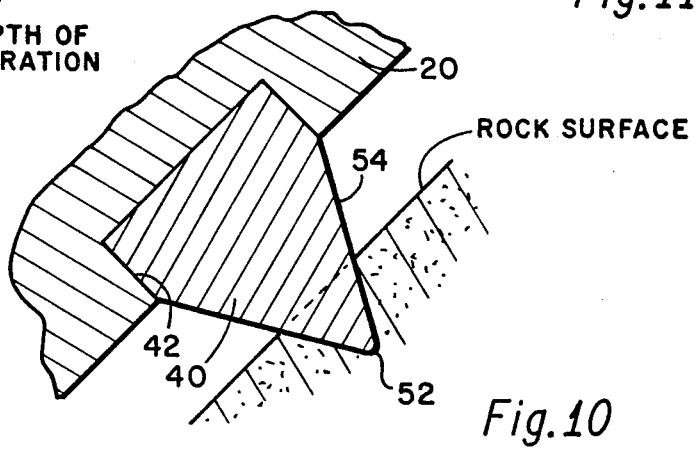
FIG. 10 is an enlarged fragmentary cross-sectional view of a drilling member and a single indentor showing the indentor penetrating a rock face.

The indentors 40 are each of very tough material and can be retained on the frusto-conical body 20 in a variety of ways. FIG. 10 shows the arrangement wherein an opening 42 receives the base of an indentor 40 such as when the indentor is press fitted into opening 30. Other means such as use of threads or the like may be employed for mounting indentors 40 to body 20.

Figure 9:
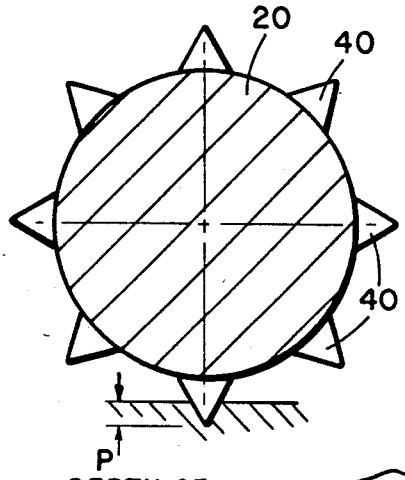
FIG. 9 is a diagrammatic cross-sectional view in a plane taken perpendicular the axis of rotation of the drilling member and showing one row of indentors thereon and illustrating the depth of penetration of an indentor as it encounters a rock face.

As shown diagrammatically in FIG. 6, the side wall boring members 16 are arranged so that as the boring tool to which they are affixed is rotated and urged in the direction of drilling which is concentric with the axis of rotation, such axis of rotation and direction of drilling being indicated by the numeral 44 in FIG. 1, the indentors 40 are urged to penetrate the rock face 12. FIG. 9 shows the depth of penetration which is equal to P. Penetration is also shown in FIG. 10. The depth of penetration P is dependent upon the nature of the rock being drilled, the amount of force applied by the boring tool urging the drilling members in contact with the rock face and the shape of the indentors 40. This invention relates to the criticality of spacing of the indentors 40, their shape, their included angle, the slope of the rock face 12, the attack angle of the indentors and the relief angle of the indentors. In addition, the spacing between indentors is an important element in the improved drilling efficiency accomplished by the present invention.

Figure 13:
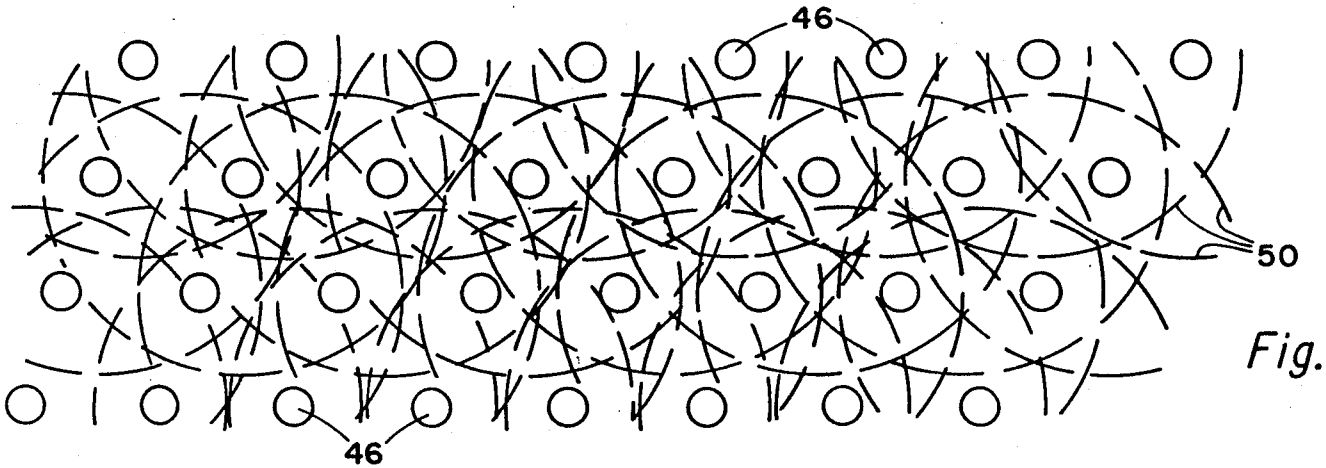
FIG. 13 is similar to FIG. 12 except it shows the tooth prints of four rows of indentors as rolled against a rock face and shows the indexing radii and that the indexing radii overlap to effect removal of rock from the rock face.
Figure 12:
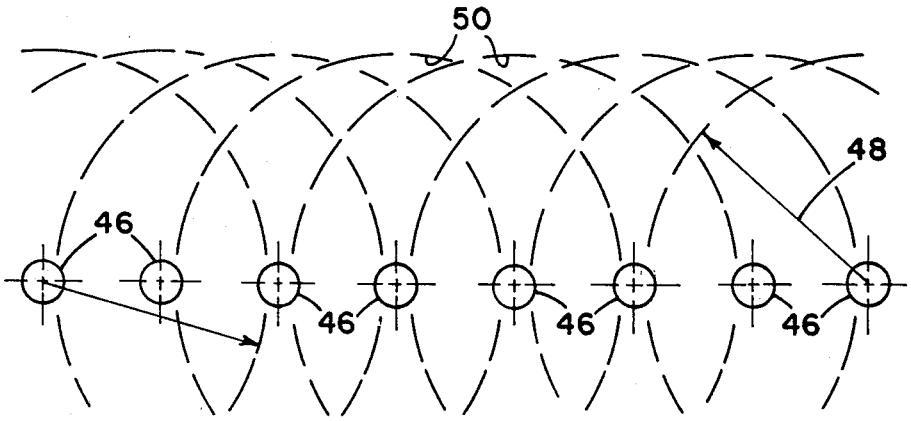
FIG. 12 is a diagrammatic layout showing the spacing between the area of penetration of a row of indentors as the indentors are rolled against a rock face and showing the effect of indexing distance as applied to improved efficiency of rock removal.
Figure 14:
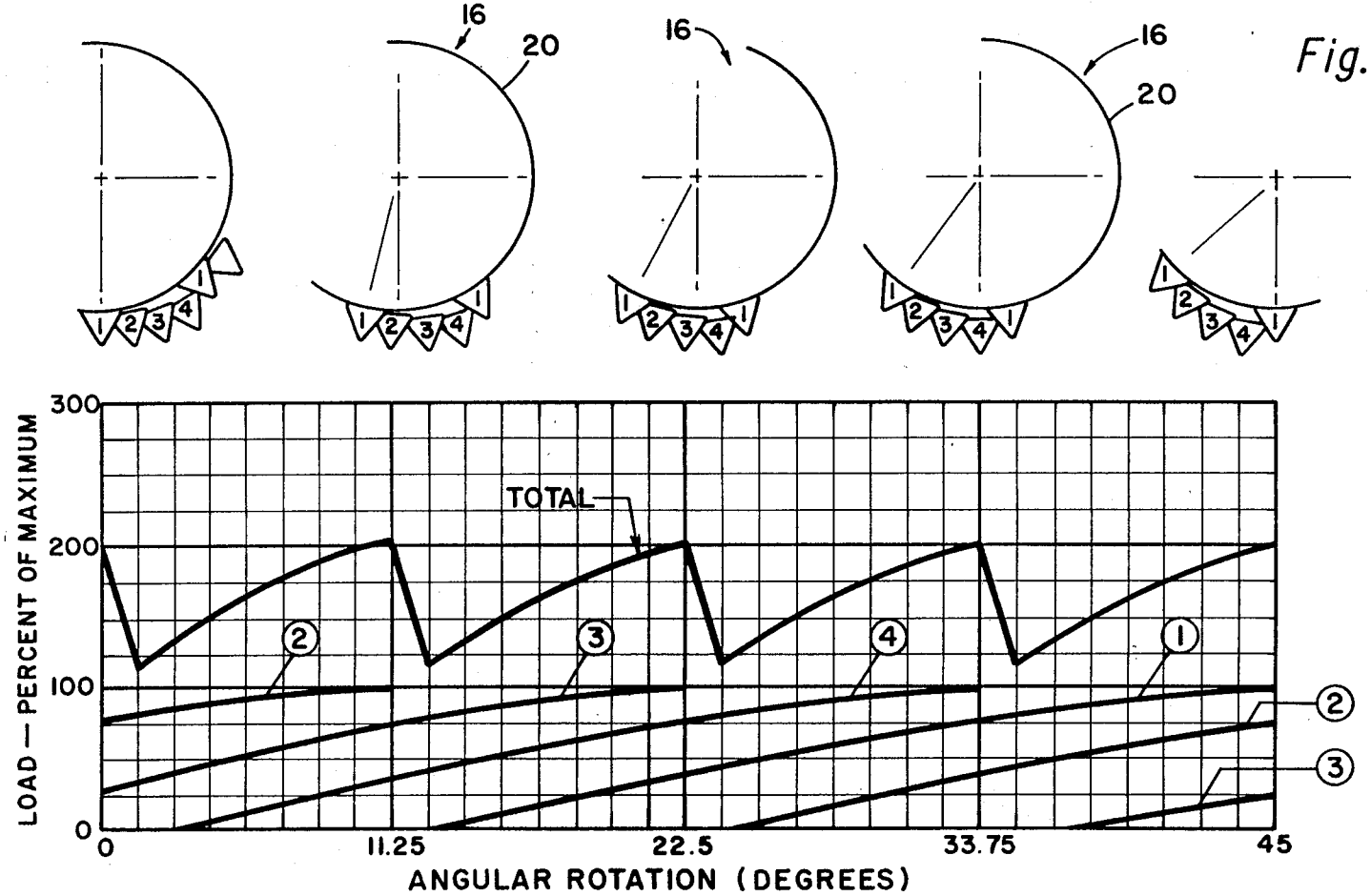
FIG. 14 is a diagrammatic view showing in the lower part of the Figure a graph will the angle of rotation as the abscissa and the load expressed in percent of maximum as the ordinate, and in the upper part of the figure showing indentors from four rows of indentors as the drilling member is rotated against the rock face. In this view it is presumed that the indentors are arranged in spacing in each row and the number of rows in the spacing therebetween so that one indentor from each row is in contact with the rock face at substantially all times.

It has been discovered that an important design criteria for most efficiently removing hard rock from a rock face is achieved by proper indexing of the indentors. The advantage of proper indexing is illustrated in FIGS. 12, 13 and 14. It has been learned that craters formed by indentors will index with each other up to a distance of 7 times the depth of penetration of the indentors, that is, 7 times P. In the preferred practice of the present invention, advantage is taken of indexing in both directions to minimize the force required for cutting rock. For this purpose the indentors are arranged on the frusto-conical body 20 with spacing between indentors in a row and spacing between rows being such that such spacing is less than the maximum indexing distance based on the planned penetration depth of the indentors. FIG. 2 shows diagrammatically the rotation of one row of indentors extending from a frusto-conical body 20, the hole of penetration of the indentors being indicated by the numeral 46. The radius 48 is 7 times the depth of penetration of the indentors, that is, 7 times P. The radius 48 is of such length as to fully encompass the next adjacent radius of indexing of each of the indentors. FIG. 13 shows the patterns created by the holes of penetration 46 of four rows of indentors and the indexing radii 48 from the holes of penetration. The arcs 50 show overlapping between the radii of indexing of the plurality of penetrations achieved by the rotation of the frusto-conical members 20 by which the indentors engage the rock face 12.

As each indentor penetrates the rock face, it causes fracturing of the rock immediately around the point of penetration, which rock crumbles away leaving a crater. It has been determined that the stress fractures produced by an indentor penetrating the rock face will index with adjacent craters to thereby form larger craters with larger pieces of the rock face being chipped away. This indexing, that is, where larger pieces of the rock face are caused to be chipped away in the spacing between the indentors, substantially increases the rate of penetration of the drilling system.

FIG. 3 shows that each indentor will index with at least three other indentors thereby augmenting the formulation of craters in the rock face. In this manner drilling or removal of rock from a rock face is accomplished by the sequential creation of a series of indexed craters.

Figure 4:
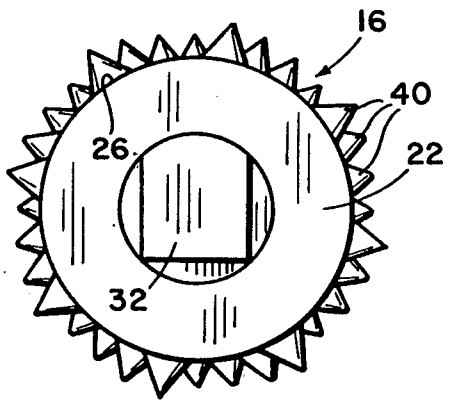
FIG. 4 is an end view taken along the line 4—4 of FIG. 3 of the frusto-conical body.

FIG. 14 shows the load applied as a side wall drilling member is rotated against a rock face. In the upper part the drawing shows five teeth, it being understood that in practice teeth extend completely around each row on the frusto-conical body 20. The graph shows the application of forces. As the pointed end 52 of an indentor first contacts a rock face, the pressure thereon increases up to 100 percent of the maximum preselected load. The gradual increase in pressure in relation to the angular rotation of each tooth one through four is illustrated in the bottom part of the chart. The saw tooth chart above the lowermost charts in FIG. 4 shows the total force applied to the side wall drilling member 16. This total force remains within predescribed upper and lower limits as the individual indentors engage and then penetrate the rock face.

Figure 11:
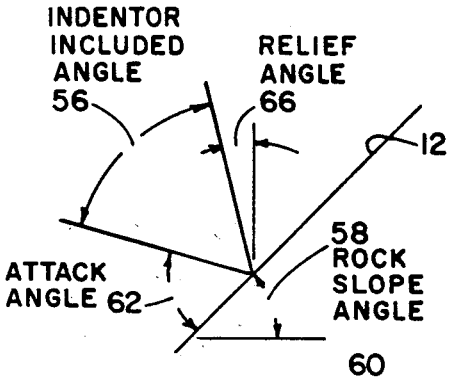
FIG. 11 is a diagrammatic view showing the angular relationships between an indentor and a rock face and showing how four critical angles are measured, these being the tooth included angle, the rock slope angle, the attack angle and the relief angle.

FIG. 11 shows the critical relationship between the indentors and the rock face 12 being drilled. While indentors may take a variety of configurations, the preferred configuration is conical as shown best in FIG. 10 thereby providing for each indentor a conical exterior surface 54, the conical surface 54 terminating at the pointed end 52. The conical surface is preferred since as the pointed end 52 wears away an increasing cross-sectional area of the indentor is encountered, thus, increasing the life of the indentor. As shown in FIG. 11, the indentor has an included angle 56.

It has been determined that the rock slope angle 58 is critical. This rock slope angle is measured by referencing the slope of the rock being drilled relative to the direction of drilling travel 60. Normally the direction of travel 60 will be coincident with the axis of rotation 44 of the boring member.

Another important angle for achieving maximum efficiency of rock removal according to the present invention is the attack angle 62. A final measurement of the relationship between each indentor and the boring wall is the relief angle, that is, the angle between the conical surface 54 of the indentor and a plane 64 drawn perpendicular to the line of travel, the relief angle being indicated in FIG. 11 by the numeral 66.

It has been determined that the required included angle 56 of an indentor 40 is between 30° and 60° ; that the preferred attack angle 62 is between 30° and 50° ; that the required slope angle of the rock face 12 is 30° to 60°, and that the required relief angle 66 is 30° to 45°.

In designing a machine to cut away a rock face, whether it is a boring machine or a road header machine, various factors must be considered, but generally the characteristic of the rock being drilled is determinative. It is apparent that maximum penetration with minimum force is obtained when an indentor 40 has a small included angle 56. However, a small included angle means a high wear rate. Thus, if the rock face being cut away is of very high compressive strength , a larger included angle 56 will be required if longer drilling tool life is required, which thereby requires adjustments in the slope angle 58, the attack angle 62 and the relief angle 66. In addition, the design depth of penetration P is determinative in the spacing between the indentors and, as previously indicated, the depth of penetration is dependent upon three main factors, that is: the compressive strength of the rock face being cut away, the force applied to push each indentor into the rock face; and the angle of inclusion 56 of the indentor.

The boring tool is made up of a plurality of side wall cutters 16 as previously described and a single center cutter 18. The preferred configuration of the center cutter is illustrated in FIGS. 6, 7 and 8. As shown first in FIG. 1, the center cutter is supported by a L-bracket 68, one leg of which attaches to a boring tool (not shown). Extending from the other leg of the bracket 68, as seen in FIG. 6, is a cantilevered axle 70. Supported by rotation about axle 70 is a generally conical body 72 having conical exterior surface 74 onto which the indentors 40 are mounted in rows as previously described with references to the side wall drilling member. The only significant difference between the center drilling member 18 and the side wall drilling member 16 is the provision of an indentor 40A in coincidence with the axis of rotation of the conical body 72. The indexing rules previously discussed apply to the center drilling member 18, that is, the indentors 40 must be spaced so that the designed penetration is not less than 1/17th of the distance between adjacent indentors.

As has been previously discussed, the preferred embodiment, including the discussion with reference to FIGS. 1 through 14, has been illustrated as the invention is applicable to a large diameter boring tool for forming a large diameter drilled opening in the earth, such drilled openings typically used for providing tunnels, wells and so forth. However, the same principles are applicable to tools for cutting away rock faces on the surface of the earth such as for road headers wherein the road header machines do not necessarily cut away a complete circular cross-section as the cutting operation advances, but some other configuration such as a channel or drainage ditch, or the like.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for cutting away a rock face of a relatively hard rock of known compressive strength, such as for drilling large diameter subterranean holes or for removing rock at the earth's surface, comprising:

a cutting head rotated about an axis and mounted for movement relative to a rock face, the cutting head being formed of a plurality of drilling members, at least one of the drilling members having an external surface, the drilling member having an axis of rotation coincident with the conical axis thereof;

means for mounting each of said drilling members for rotation about its said axis of rotation;

a plurality of spaced apart indentors secured to said drilling member external surface, each indentor having an end point, the indentors being adaptable to penetrate into the rock face upon the application of working force a distance P, and wherein said indentor end points are spaced a distance of not greater than 7 P apart; and wherein the apparatus includes means of applying to it a force moving the apparatus in a preselected direction of drilling, and wherein the apparatus is configured to attain a rock face configuration wherein the slope of the rock face relative to the direction of drilling is between 30° and 60°.

2. An apparatus according to claim 1 wherein each said indentor is substantially conically shaped on its outer surface and wherein the included conical angle is between 40° and 60°.

3. An apparatus according to claim 1 wherein each said drilling member is mounted with respect to the rock face such that the attack angle between each indentor conical surface and the rock face is between 30° and 50°.

4. An apparatus according to claim 1 wherein the slope of the rock face relative to the direction of drilling is about 40°.

5. An apparatus according to claim 1 adapted for drilling a large diameter hole in earthen rock and wherein the apparatus includes means of applying to it a force moving the apparatus in a preselected direction of drilling and wherein the relief angle between the conical surface of each of said indentors and a plane perpendicular the said direction of drilling is between 30° and 45°.

6. An apparatus according to claim 1 adapted for drilling a large diameter hole in earthen rock and wherein the apparatus includes means applying to it a force moving the apparatus in a preselected direction of drilling, wherein the apparatus is configured to attain a rock face and wherein:

(a) each said indentor is substantially conically shaped on its outer surface and wherein the included conical angle is between 40° and 60°;

(b) the slope of the rock face relative to the direction of drilling is between 30 ° and 60°;

(c) the attack angle between each indentor conical surface and said rock face is between 30° and 50°; and (d) the relief angle between the conical surface of each indentor and a plane perpendicular to the direction of drilling is between 30° and 45°.

* * * * *